US007513135B2

(12) United States Patent
Denkmeier

(10) Patent No.: US 7,513,135 B2
(45) Date of Patent: Apr. 7, 2009

(54) MANUFACTURING DEVICE, PARTICULARLY A FOLDING PRESS, HAVING ELECTRONIC TOOL DETECTION

(75) Inventor: Thomas Denkmeier, Traun (AT)

(73) Assignee: TRUMPF Maschinen Austria GmbH & Co. KG., Pasching (AT)

( * ) Notice: Subject to any disclaimer, the term of this patent is extended or adjusted under 35 U.S.C. 154(b) by 627 days.

(21) Appl. No.: 10/519,828

(22) PCT Filed: Jun. 30, 2003

(86) PCT No.: PCT/AT03/00181

§ 371 (c)(1),
(2), (4) Date: Aug. 23, 2005

(87) PCT Pub. No.: WO2004/002650

PCT Pub. Date: Jan. 8, 2004

(65) Prior Publication Data

US 2006/0042339 A1 Mar. 2, 2006

(30) Foreign Application Priority Data

Jul. 1, 2002 (AT) ..... A 977/2002

(51) Int. Cl.
*B21D 37/04* (2006.01)
*B21D 5/02* (2006.01)

(52) U.S. Cl. ..... 72/15.1; 72/31.01; 72/31.1; 72/389.3; 72/481.1; 29/867; 356/138

(58) Field of Classification Search ..... 72/14.8, 72/15.1, 17.1, 20.5, 31.1, 31.01, 31.12, 389.3, 72/389.6, 419, 420, 462, 466.8, 481.1, 481.6, 72/481.93; 700/97, 145; 356/138, 375, 398; 29/863, 867; 364/474.21, 476.01
See application file for complete search history.

(56) References Cited

U.S. PATENT DOCUMENTS 4,742,470 A * 5/1988 Juengel ..... 700/175
5,595,560 A * 1/1997 Kamada ..... 72/442
5,642,307 A * 6/1997 Jernigan ..... 365/103

(Continued)

FOREIGN PATENT DOCUMENTS

DE 38 24 734 A1 1/1990

(Continued)

OTHER PUBLICATIONS

International Search Report for PCT Application No. PCT/AT2003/00181; Filed Jun. 30, 2003; Date of Completion Oct. 9, 2003; Date of Mailing Oct. 20, 2003.

*Primary Examiner*—David B Jones
(74) *Attorney, Agent, or Firm*—Alston & Bird LLP

(57) ABSTRACT

The invention relates to production unit (1), in particular a bending press (2), for forming workpieces (3) of sheet metal, having two press beams (15, 16) which are displaceable relative to one another by means of a drive mechanism (53) and can be used to obtain a required tool length (42) by fitting a variable number of bending tools (36, 37). To enable them to be identified and/or their positions detected on an at least partially automated basis, the inserted bending tools (35, 37) have unmistakable codes in the form of electronically detectable information carriers (43). To this end, an electronic detection device (44) for detecting a plurality of information carriers (43) connected to a control device (46) or a control and/or evaluation device (47) connected to it co-operates with the first and/or second press beam (15; 16), and at least one displacement and/or guide mechanism (45) is provided which extends essentially parallel with the achievable tool length (42) and accommodates the detection device (44). The codes or data and/or detection signals of a plurality of information carriers (43) can be detected in sequence during a relative displacement of the detection device (44) along the displacement and/or guide mechanism (45) and can be transmitted to the control device (46) or the control and/or evaluation device (47) co-operating with it.

27 Claims, 7 Drawing Sheets

U.S. PATENT DOCUMENTS

| | | | | |
|---|---|---|---|---|
| 5,983,688 | A * | 11/1999 | Anzai et al. | 72/15.1 |
| 6,047,579 | A * | 4/2000 | Schmitz | 72/15.1 |
| 6,526,793 | B1 * | 3/2003 | Danko et al. | 72/17.1 |
| 7,243,516 | B2 * | 7/2007 | Zusi | 72/20.1 |
| 7,325,428 | B2 * | 2/2008 | Bruggink | 72/15.1 |
| 7,353,677 | B2 * | 4/2008 | Zusi | 72/15.1 |
| 7,392,678 | B2 * | 7/2008 | Niwa et al. | 72/31.01 |
| 2005/0016235 | A1 * | 1/2005 | Zusi | 72/15.1 |

FOREIGN PATENT DOCUMENTS

| | | | |
|---|---|---|---|
| DE | 38 30 488 | A1 | 3/1990 |
| DE | 44 42 381 | A1 | 5/1996 |
| EP | 0 919 300 | A1 | 6/1999 |

* cited by examiner

MANUFACTURING DEVICE, PARTICULARLY A FOLDING PRESS, HAVING ELECTRONIC TOOL DETECTION

BACKGROUND OF INVENTION

The invention relates to a production unit, in particular a bending press, for forming workpieces of sheet metal, having two press beams which are displaceable relative to one another by means of a drive mechanism and which can be used to obtain a desired tool length by fitting a variable number of bending tools, and having a control device connected to the drive mechanism for influencing the operating behaviour of the production unit as a function of states detected by sensors, manual control commands and/or specifications stored in a memory device, in which the inserted bending tools have machine-readable unmistakable codes in the form of electronically detectable information carriers to enable them to be identified and/or their position detected on an at least partially automated basis, and an electronic detection device provided as a means of identifying a plurality of information carriers and connected to the control device or to a control and/or evaluation device co-operating with it co-operates with the first and/or second press beam, at least one displacement and/or guide mechanism being provided, extending essentially parallel with the achievable tool length, which accommodates the detection device so that the codes or data and/or detection signals of a plurality of information carriers can be detected consecutively and can be transmitted to the control device or the control and/or evaluation device co-operating with it.

Patent specifications DE 38 24 734 A1 and DE 38 30 488 A1 disclose a production unit 1 for processing metal, in particular a die bending machine or a die forging press, with an electronic tool detection system. A set of bending tools for these units consists of at least a top tool, in particular a stamp, and a bottom tool, in particular a die. However, these tools can also be split up into segments, i.e. separated, so that the smaller tool parts are easier to handle. At least one electronically detectable code carrier is mounted in the respective individual tools, which contains all the geometric data defining the tool and the permissible tool load data. Alternatively, the code carrier may also be defined by nothing more than a tool code if the tool data is stored in the machine controller. In order to be able to read the code carriers in the tools, at least one reading head is mounted respectively in the region of the tool holder mechanisms, i.e. on the press beam and on the press table. These reading heads provided for each code carrier enable the tool data or tool codes of the individual code carriers to be detected and transmitted to the machine controller. The disadvantage of this is that it is necessary to provide a plurality of reading heads in order to detect one of a plurality of possible work tools for every bending tool, which means that a relatively complex cabling and wiring system is needed, amongst other things. In addition, situations may arise in which a new set of bending tools does not match the disposition of the reading heads because of a different pitch distance, so that either the disposition of the individual reading heads has to be changed or the positioning of the code carrier on the bending tools has to be adapted, which then requires a series of awkward manipulations.

Document DE 44 42 381 A1 discloses a device for detecting the position and shape of top cheek tools on die bending machines and die presses. Disposed behind a top cheek in a guide is a motor-driveable carriage on which a holder is mounted. Integrated in the holder is a photoelectric barrier with transmitter and receiver, which co-operates with an electronic evaluation system to determine the length of the top cheek tools fitted in the top cheek and the spaces in between them by means of reflection. Also disposed in the holder is a writing-reading head, the purpose of which is to read codes provided in code carriers in the rear face of the top cheek tools. The information is scanned by passing the writing-reading head across them and then evaluated by an electronic evaluation system.

Document EP 0 919 300 A1 discloses a bending press for forming workpieces of sheet metal, in which a press beam co-operates with a scanner which scans identification codes or symbols and a position detecting device which detects the position of the scanner. The bending press has a display device and a memory so that position-related data from the scanner and position-related data form the position detecting device can be read in conjunction with one another and stored in the memory. A top or a bottom frame is moved in a vertical direction, releasable impact dies or bending tools being disposed in the top frame. The die disposed in the bottom frame is compared with the dies in the top frame. The reading device is displaced in a guide device, horizontally with respect to the top frame, until the scanner reads an identification code or symbols. The data is read and the position-related data from the reading device is stored in the memory.

SUMMARY OF THE INVENTION

The underlying objective of the present invention is to propose a production unit for forming workpieces of sheet metal, which permits a reliable identification and/or position detection of the inserted bending tools, even if there is a plurality of different configurations, thereby obviating the need for any complex re-fitting or adaptation work on the tool detection system, in particular with regard to its structure.

This objective is achieved by the invention as a result of the displacement and/or guide mechanism 45 for the detection device 44 recessed in a press beam 15 or in the press table or at least partially integrated therein.

The advantage achieved as a result is that only a single detection system is needed for the electronic information carriers to enable the bending tools of the press beam and/or the press table to be electronically detected. Furthermore, hardly any re-fitting work is needed in order to ensure that the individual bending tools provided for any work application can be reliably detected in different tool configurations. All in all, the specified production unit is therefore particularly flexible in terms of the possible tool distances or number of tools and the electronic detection of them is reliable. Another particular advantage is the fact that, because the detection device is forcibly guided during its displacement, the individual tool data sets or tool codes can be detected in a consecutive sequence, which means that the sequence of whatever bending tools are inserted can be easily detected by the control device. This detection takes place without an exactly defined specification having to be entered at the electronic control device. Another advantage of the design proposed by the invention resides in the fact that the individual information carriers are read in sequence, which means that the maximum number of detectable tools is no longer restricted by hardware-related constraints, such as a limited number of available inputs, for example. The number of detectable bending tools can therefore be extended with relatively little difficulty. The specified design also facilitates and improves the task of detecting the position of the individual bending tools. Accordingly, the position can be detected in combination with or as an alternative to identification of the tools themselves.

Another embodiment, wherein the displacement and/or guide mechanism is disposed in a groove-shaped recess in a tool holder mechanism and the recess extends into the press beam and into a table top of the press table, is of advantage because it also enables displacement and/or guide mechanisms of relatively large dimensions to be accommodated.

Also of advantage is another embodiment, wherein the recess extends approximately across the maximum possible tool length, because it enables whatever bending tools are retained in the tool holder mechanism to be fully recorded or detected.

In. another embodiment, a hollow compartment closed towards the outside is provided in the press beam and in the press table. As a result, the displacement and/or guide mechanism or at least its transport element and the detection device are safely housed to protect them from outside influences or the effects of forces and the pulley blocks disposed on the end-face or distal end regions of the press table merely guide the endless transport element together with the detection device in the interior of the machine frame.

In a further embodiment, a plate-type cover element is provided between the hollow compartment and the groove-shaped recess in the tool holder mechanism. As a result, dirt is prevented from getting to the transport element and detection device disposed underneath the bending tools.

Advantage is also to be had from an embodiment in which the detection device is coupled with the control and/or evaluation device via a line connection so as to transmit signals, because a reliable signal and data transmission can be achieved from the detection device to the control device and vice versa and the risk of outside influences is low or can be minimized using simple technical measures, such as screening elements, for example.

Also of advantage is an embodiment in which the line connection is provided in the form of a trailing cable system disposed within the displacement and/or guide range of the detection device, since it permits a relatively extensive displacement range within which a reliable signal and data transmission can be set up whilst requiring very little in the way of cabling and wiring.

Of particular advantage is an embodiment wherein a maximum detection distance between the displaceably mounted detection device and an information carrier of an adjacent bending tool is shorter than a smallest possible distance between two information carriers of bending tools lined up in a row adjacent to one another without any gaps, since these features provide a simple means of ensuring that the respective data or codes from the plurality of information carriers are received or picked up consecutively in sequence at the detection device. The risk of faulty detection is therefore minimized and this approach is also conducive to detecting the sequence or disposition of the individual tools.

Also of advantage is an embodiment in which the displacement and/or guide mechanism is a flexible transport element to which the detection device is attached, since it enables longer displacement paths or tool lengths to be bridged without difficulty and makes for an inexpensive displacement and/or guide mechanism.

A variant in which the flexible transport element is guided round two mutually spaced pulley blocks or winding spools is of advantage because it is based on a simple mechanical structure, by means of which the detection device can be moved across extensive distances with sufficient guiding accuracy, given the dimensions of the detection device.

An alternative embodiment characterized in that the displacement and/or guide mechanism has a guide element with a guide carriage relatively displaceable thereto, on which the detection device is disposed. The advantage of this is that it secures a relatively precise forced guiding action for the detection device along the possible tool length.

Also of particular advantage is an optional embodiment wherein the displacement and/or guide mechanism has a displacement drive connected to the control device, since it enables the detection device to be at least partially or predominantly automated.

Advantageously, the displacement drive can be reversed in its direction of rotation or motion. As a result, a bi-directional displacement of the detection device can be automated. Furthermore, by designing a cable link accordingly, twisting in the cable which is likely to cause damage can be ruled out, in addition to which, the individual information carriers can be scanned twice or more within a relatively short time.

In another embodiment wherein the information carriers are transponders that can be detected contactlessly or without being touched, the demands placed on the displacement and guide device are low and the occurrence of wear due to components rubbing or sliding against one another is ruled out.

Advantageously, the transponders can be inductively or electromagnetically coupled with the detection device via corresponding transmitter and/or receiver devices for electromagnetic waves. As a result, at least the communication and transmission run for information and data signals between the detection device and the information carrier can be of a contactless or wireless design. It is also preferable if electric operating power for the passive information carrier is transmitted wirelessly between the detection device and the information carriers via these transmitter and/or receiver devices or alternatively via separate transmitter and/or receiver units. Furthermore, information carriers of this type can also be read or detected without any difficulty, even if the guiding or displacement accuracy of the displacement and/or guide device is low.

Another possible embodiment, wherein the detection device is able to intervene by reading and writing to a non-volatile memory device of the information carriers or transponders, is of particular advantage because changing data and cumulative historical data can be stored via the detection device in the memory device as and when necessary, which means that the information carriers will always contain up to date information and data.

Another possible embodiment is characterized in that the information carriers have a passive position detection element, the advantage of which is that, although simple means are used, the relative position of bending tools within the possible length within which tools can be mounted is determined sufficiently accurately. This advantageously means that there is no need to make any adjustments or modifications to the bending tools or position-detecting elements.

Claim 19 specifies an inexpensive passive position-detection element which can be reliably detected.

In another embodiment, the detection device has an inductive sensor, in particular a Hall-effect sensor, for detecting a metal screen or another metal element on or in the region of an information carrier. This embodiment enables contactless detection of the presence and/or position of a bending tool, using inexpensive but reliable means.

In accordance with still another embodiment of the invention wherein the detection device or control and/or evaluation device has a distance measuring device that measures the displacement path travelled by the detection device, the instantaneous position of a specific tool within the possible tool length can be detected, for example from a defined tool initial point, so that it can be evaluated and taken into account in the subsequent sequences to be run.

In a further embodiment, the displacement and/or guide mechanism is a displacement drive and has a stepper motor connected to the control and/or evaluation device for determining the displacement path and/or controlling the displacement path. A multi-use or multi-functional use of the displacement drive is thus made possible, namely for detecting the position of various bending tools on the one hand and as a displacement drive for automating the displaceable detection device, on the other.

As a result of the embodiment in which the flexible transport element has at least one electric conductor track which has an electrical connection to the detection device, there is no need for trailing cable systems between the displaceable detection device and a stationary machine part, which also means that a reliable hard-wired signal transmission is possible from the displaceable detection device to a fixed or stationary point of the production unit, even if there is limited space.

Finally, an embodiment in which the displacement and/or guide mechanism has a spindle drive on which the detection device is mounted and is displaceable in two directions along the possible tool length by a reversible rotating motion of a threaded spindle of the spindle drive, is of advantage because it guarantees a slip-free displacing motion of the detection device along the requisite tool length and simple technical means are used to define and monitor a displacement path of the detection device relative to the tool length and relative to a defined zero or initial point.

BRIEF DESCRIPTION OF THE DRAWINGS

The invention will be described in more detail below with reference to examples of embodiments illustrated in the appended drawings.

Of these.

DETAILED DESCRIPTION OF PREFERRED EMBODIMENTS

Figure 1:
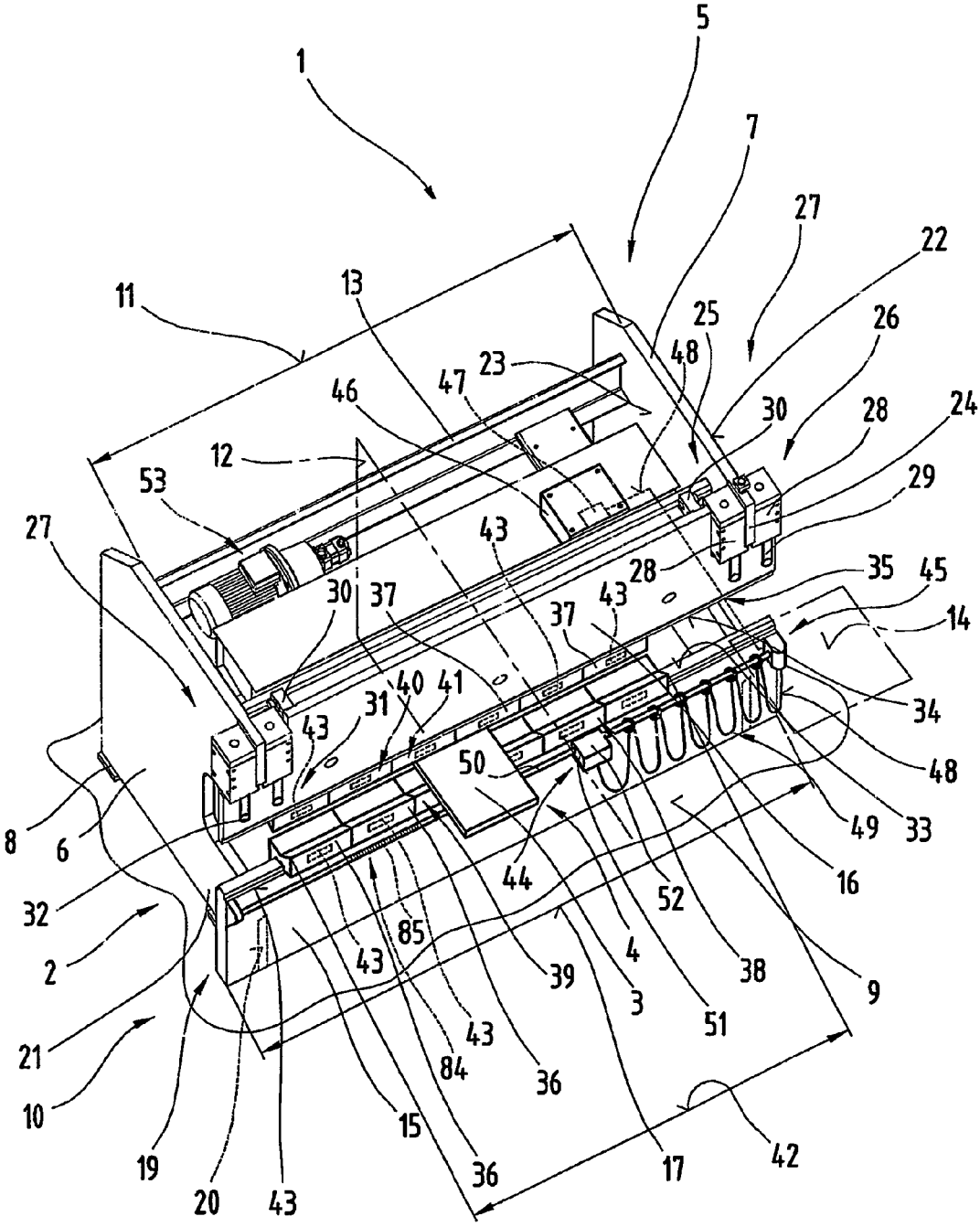
FIG. 1 is a simplified, perspective diagram of a production unit with the fittings proposed by the invention.

Firstly, it should be pointed out that the same parts described in the different embodiments are denoted by the same reference numbers and the same component names and the disclosures made throughout the description can be transposed in terms of meaning to same parts bearing the same reference numbers or same component names. Furthermore, the positions chosen for the purposes of the description, such as top, bottom, side, etc,. relate to the drawing specifically being described and can be transposed in terms of meaning to a new position when another position is being described. Individual features or combinations of features from the different embodiments illustrated and described may be construed as independent inventive solutions or solutions proposed by the invention in their own right.

Figure 2:
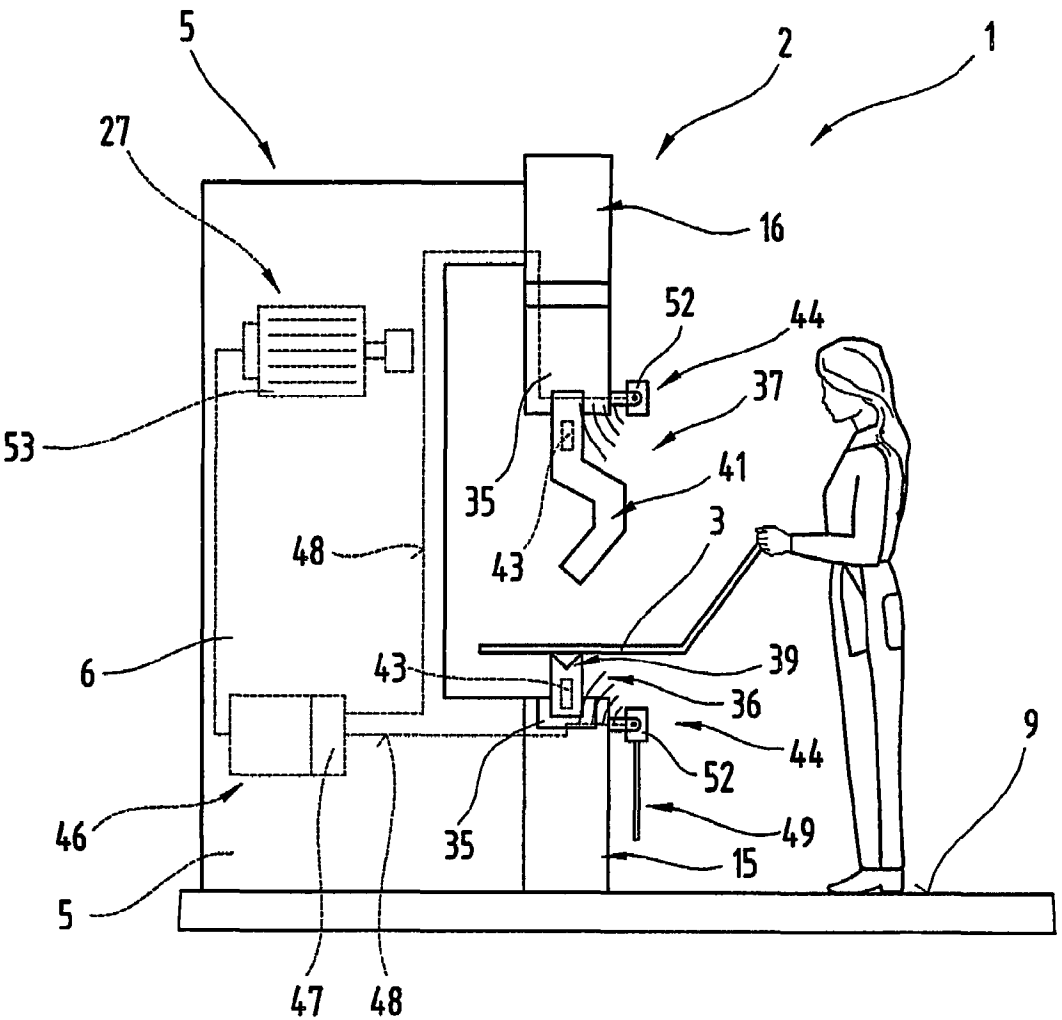
FIG. 2 is a simplified schematic diagram in a side view showing a dual embodiment of the displacement and/or guide mechanism used for detecting the tool.

FIGS. 1 and 2 illustrate a production unit 1, in particular a bending press 2, for shaping workpieces 3, in particular to produce housing parts 4, sections, etc. This production unit 1 may also be used to make elongate sections, such as angled sections, U-sections, Z-sections, etc., with a very high ratio of length to cross section, for example.

A machine frame 5 of the production unit 1 essentially consists of two substantially C-shaped stand-side panels 6, 7 disposed at a distance apart from one another, which are supported on a floor 9, either directly or, for example, via damping elements 8, if necessary, or in another embodiment, as illustrated in this example, secured to a common base plate 10, in particular welded thereto. The stand-side panels 6, 7 are also joined to one another across a distance 11 by means of wall parts 13 extending perpendicular to a vertical mid-axis 12.

By reference to a working plane 14 extending parallel with the floor 9, the production unit 1 has two oppositely lying press beams 15, 16 extending across a length 17, which is generally determined by the size of the machine in question and the working length made available for bending the workpieces 3.

The press beam 15 directed towards the floor 9 is secured to the machine frame 5 by means of a fixing system 19, preferably directly on front faces 20 of legs 21 of the C-shaped stand-side panels 6, 7 assigned to the base plate 10, in particular by means of a welded joint. Provided on side faces 22, 23 of spaced apart legs 24 of the C-shaped stand-side panels 6, 7 directed towards the floor 9 are actuator drives 25, 26 of the drive system 27, to which a pressurising medium can be applied, these being double acting hydraulic cylinders 28. Actuator elements 29, e.g. piston rods of the hydraulic cylinders 28, are drivingly connected via articulated bearings 31 and bolts 32, for example, to the press beam 16 which is mounted in guide means 30 of the machine frame 5 so that it can be displaced in a direction extending perpendicular to the working plane 14. The press beam 15 and the press beam 16 extend across the length 17 in a substantially symmetrical arrangement and in the direction perpendicular to the mid-plane 12, the length 17 being slightly longer than the distance 11.

On mutually facing front faces 33, 34 extending parallel with the working plane 14, the press beams 15, 16 have tool holder devices 35 for supporting and reliably attaching bending tools 36, 37. In a manner known from the prior art, these bending tools 36, 37 generally comprise a bending die 39 in the form of a die 38 and a bending stamp 41 in the form of a stamp 40. The tool holders 35 on the press beams 15, 16 are designed fore releasably securing the bending tools 36, 37 on the one hand and also form support surfaces for transmitting bending forces on the other hand.

As also known from the prior art, the bending tools 36, 37 are divided into sections, so that the tool length 42 can be easily varied in order to adapt to specific requirements and also to change equipment on the production unit 1 or replace the bending tools 36, 37 more easily. In particular, by lining up several bending tools 37 in a row on the top press beam 16 and by lining up several bending tools 36 matching them in a row on the bottom press beam 15 or press table, the requisite tool length 42 can be set up and configured by an operator of the production unit 1.

Likewise, the operator may consciously line up bending tools 36 and 37 which are different in terms of their properties or parameters, on the bottom press beam and/or on the top press beam within the required tool length 42, depending on a particular specification. For example at least one of the bending tools 36 or 37 may be of different dimensions or have a slightly different geometry than the middle bending tools 36 or 37 within the assembled tool length 42. This means that the end region of a workpiece 3 to be formed may be of a different shape from the middle region or the distal end region of the workpiece 3. Similarly, it would be conceivable to form the middle region in a different way from the two end regions. Depending on the tool length 42, it is also possible to apply slightly different contact pressures or, in order to bend or shape the workpieces keeping them as exactly constant as possible, it may be expedient to use different shapes of bending tools 36 or 37 aligned in a row within the tooth length 42. Consequently, any pressure differences or slight deviating movements of the production unit 1, in particular the press beams 15, 16, which occur on exposure to high contact forces, can be at least partially compensated, thereby enabling an improved and in particular more dimensionally accurate bending or forming result to be obtained. The individual bending tools 36 and 37 aligned in a row within the desired or required tool length 42 may barely differ in terms of their geometric dimensions and these slight differences in size are very difficult to see with the naked eye or not perceptible at all. The differences between the individual bending tools 36 or 37 which make up the bending die 39 and used to make up the bending stamp 41 thus move within the range of a few tenths of millimeters to a few millimeters and are therefore barely perceptible to the eye.

In order to be able to differentiate between them, these different bending tools 36 and 37 inserted to set up a defined tool set in the form of a bending die 39 or a specific bending stamp 41 may be colour coded or may be provided with information in the form of numbers or graphics. These code systems, which generally visual in nature, are the means by which the operator is able to tell which belong together to make up an appropriate set for the desired bending die 39 or for the desired bending stamp 41.

As an alternative to or in combination with these visual coding systems for the operator, the individual bending tools used to form the desired bending die 39 and/or the bending tools 37 used to set up the matching bending stamp 41 are provided with at least one electronically or electrically detectable information carrier 43. This information carrier 43 for the individual bending tools 36; 37 or for the individual segments of the bending die 39 or the bending stamp 41 contain either data about relevant properties or specifications of the respective bending tools 36, 37 or the information carrier 43 simply contains an unmistakable identifying code behind which is a specific data set with a plurality of data about the bending tool 36; 37. In other words, by using an unmistakable or different code for the information carriers 43 which does not require a large amount of memory, a large quantity of data relating to the specific type of the respective tool can be defined or virtually stored directly on the bending tools 36 and 37 but involves only relatively small quantities of data and a low memory requirement. Above all, if only small quantities of data are to be transmitted or read from the information carrier 43, it is preferable to use an electronic code as the information carrier 43 for identifying the respective bending tools 36 or 37 for a specific and detailed data specification on the bending tools 36; 37. This being the case, the information carrier 43 is more particularly provided in the form of an electronically detectable code, for example an electric oscillator circuit with defined properties, which describes the respective bending tool 36 or 37 almost indirectly in the associated, externally disposed data set for this code, which is evaluated and electronically processed by an electronic circuit of a controller.

In order to pick up the respective code or data from the individual information carriers 43 in the individual bending tools 36 and/or in the individual bending tools 37 electrically or electronically, at least one detection device 44 is provided, which is displaceable relative to the machine frame 5. This electric or electronic detection device 44 for the individual information carriers 43 may be displaced by hand, i.e. manually, relative to the bending tools 36; 37 and their information carriers 43 and/or may be moved on an automated basis, as will be described in more detail below.

The detection device 44 co-operates with a displacement and/or guide mechanism 45 and is mounted so as to be displaceable relative to it so that it can be moved along the individual bending tools 36 and 37 of the bending die 39 and the bending stamp 41. As a result of the detection device 44 co-operating with the displacement and/or guide mechanism 45 and displaceable relative to it, a detection device 44 which has a relatively limited detection width or detection range can nevertheless detect the information carriers 43 reliably over relatively extensive or widespread ranges.

As schematically indicated in FIG. 1, by using nothing more than a movable or displaceable detection device 44, it is possible to detect or read both the information carrier or carriers 43 of the bending stamp 41 as well the information carrier or carriers of the bending die 39. The codes or data of the information carriers 43 are preferably read without touching or contactlessly. In particular, the codes or data are received and picked up by the detection device 44 via a so-called "air transmission distance". In order words, a defined air gap or free space is left between the bending tools 36 and 37 or their information carriers 43 and the displaceable detection device 44, across which the individual codes or data are transmitted to the detection device 44.

An electric or electronic control device 46 controls or regulates at least the basic sequences and functions of the production unit 1. The detection device 44 for the individual information carriers 43 is connected to this control device 46 or a control and/or evaluation device 47 cooperating with this control device 46. At least one line connection 48 is preferably provided between the detection device 44 and the control and/or evaluation device 47 as a means of transmitting signals or data issued or generated by the detection device 44. In the region of the displacement and/or guide mechanism 45, this line connection 48 may be provided in the form of a trailing cable system 49, by means of which a defined displacement range is obtained for the detection device 44, and which provides a preferably electric or optionally also optical signal link to the control and/or evaluation device 47. A trailing cable system 49 of this type offers a reliable signal or data transmission from the detection device 44 to the electronic control and/or evaluation device 47 and vice versa. Instead of using a trailing cable system 49 with cable handles borne on carriages, it would naturally also be possible to provide a cable drum system, from which the trailing cable can be unwound and wound. In particular, any trailing cable systems may be used, provided they will guarantee a secure electric or light-conducting connection between the control device 47 and the detection device 44.

The data or information or codes picked up by the detection device 44 are incorporated in the control sequences and the available functions of the bending press 2 by the control and/or evaluation device 47 and/or by the actual control device 46.

The specific features or respective specifications of the bending tools 36 and 37 inserted in the bending press 2 may be detected by the detection device 44 and the displacement and/or guide mechanism 45 on an automated basis, at least to a certain extent, and evaluated by the control device 46, which is preferably programme or software driven. The respective data or codes of the information carriers 43 will specifically influence the behaviour and the processing sequences of the bending press 2 in a manner that will be described below.

The displacement and/or guide mechanism 45 specifically enables the detection device 44 to be displaced in an exactly defined manner along the longitudinally extending bending tools 36 and 37, which usually comprise several assembled individual tools. This ensures that none of the individual tools are skipped or passed over or otherwise missed, as can happen with a handheld detection device 44 in the form of a hand scanner in certain circumstances. The displacement and/or guide mechanism 45 also ensures that the detection device 44 always keeps to a defined, error-free reading or detection distance from the individual information carriers 43 at all times. If the maximum reading range or the maximum possible reception range were exceeded, this would lead to faulty reading or to gaps in the individually detected, almost serially disposed information carriers 43 of the respective bending tools 36 and 37. Advantageously, this can be reliably prevented by the displacement and/or guide mechanism 45.

The displacement and/or guide mechanism 45 may be provided in the form of at least one guide element 50, for example, which runs along the bottom and/or the top press beam 15, 16, in the form of a guide rail or a guide shaft, for example. A guide carriage 51 is mounted so as to be linearly displaceable along this guide element 50. The detection device 51 incorporating a transmitter and/or receiver device 52 for electromagnetic waves is disposed or mounted on this guide carriage 51. By means of this transmitter and/or receiver device 52 for operating a radio transmission and/or a radio reception, the information carriers 43 in or on the individual bending tools 36 or 37 can be read, in particular detected, without touching or making contact.

Via the line connection 48 running from the detection device 44 to the control and/or evaluation device 47, the appropriate information or signals are reliably transmitted from the information carriers 43 across relatively large distances. The detection device 44 preferably also has a transformer or amplifier for the signals to be transmitted from the information carriers 43 to the control and/or evaluation device 47.

If the data or information detected from the codes by the detection device 44 does not tally with transmitted or pre-set values, in particular the desired values set in the control device 46, at least an indication or alarm report is emitted and the work sequence of the bending press 2 is interrupted or is not initiated at all. This avoids any damage to the bending press 2 or the bending tools 36; 37 and reduces sources of wastage or faulty workpieces 3. Injury to the operator due to overloaded and, under certain circumstances, breaking machine parts or workpieces 3 is also avoided or at least the risk of injury to the operator is reduced. In particular, the data obtained from the bending tools 36 and 37 can be checked to ascertain whether the current configuration of the bending press 2 is suitable for the intended work sequences or not. Only if a positive control or comparison result is obtained can the work sequences pre-set in a control programme be carried out or initiated. Otherwise, an alarm or error report is issued and the bending press 2 is preferably shut down until it can be placed or maintained in a safe operating state whilst the correct configuration or equipment has been set up with the requisite bending tools 36 and 37. In particular, the actuator drives 25, 26 of the drive system 27 and/or a drive mechanism 53 of a hydraulic unit driven by an electric motor is placed in a non-operating mode until such time as the actual configuration matches the desired configuration, which is preferably stored in a memory of the control device 45 and/or manually entered.

FIG. 2 illustrates a dual embodiment of a detection device 44 with a displacement and/or guide mechanism 45 for the information carrier 43. In particular, a respective detection device 44 and a displacement and/or guide mechanism 45 for detecting a plurality of information carriers 43 in or on the bending tools 36 and 37 co-operate with the bottom press beam 15 and the top press beam 16. The fact of providing a detection device 44 for the top bending tools 37 constituting the bending stamp 41 and by providing an independent detection device 44 for the bending tools 36 constituting the bending die 39 means that the individual information carriers 43 can be correctly scanned, even if the reading or detection range is relatively short or if the reception sensitivity is relatively low. These two specifically assigned detection devices 44 may optionally be placed on a common displacement and/or guide mechanism 45. This being the case, the two detection devices 44 are always moved simultaneously and in an absolutely identical manner.

Each of these detection devices 44 has a respective transmitter and/or receiver device 52 for electromagnetic waves which can be received form the information carriers 43. In response to a wirelessly or contactlessly received scanning or power signal, i.e. a signal supplying energy, the information carriers 43 send their respective code or stored data to the relevant detection device 44 which prompted the query or in the immediate surrounding environment so that they can be picked up by the detection device 44. Each of the detection devices 44 in the region of the top and bottom press beam 15, 16 or in the region of the tool holder mechanisms 35 for the bending tools 36, 37 is connected via a line connection 48, in particular a cable connection, to the control device 46 or its control and/or evaluation device 47.

As a result of the dual or double-function embodiment of the detection device 44 and by setting up a specific assignment to the top and bottom bending tool 36, 3, a check can be run to ascertain whether bending tools 36, 37 which belong together or a specific bending stamp 41 and an associated bending die 39 are mounted on the bending press 2. If this is not the case, the control device 46 will prevent a shaping or bending process from being performed by the bending press 2. As mentioned above, the at least partially automated tool detection prevents or at least reduces the risk of damage to mechanical components of the production unit, the production of unusable workpieces and the risk of injury to the operator.

In order to scan the information carriers 43 or detect the bending tools 36 and 37 in place along the current tool length 42, the electronic detection device 44 can be manually displaced along the displacement and/or guide mechanism 45, for example. To this end, the detection device 44 must be moved at least once along the current tool length 42. The respective information carriers 43 in the bending tools 36 and/or 37 are preferably scanned or detected during the forcibly guided movement of the detection device 44 along the displacement and/or guide mechanism 45 and continuously transmitted to the control device 46 or the control and/or evaluation device 47. These codes or data are preferably transmitted to the control and/or evaluation device 47 "on the fly", i.e. without being temporarily stored in the detection device 44. The respective information or data is picked up from the information carriers 43 during the more or less continuous, linear motion of the detection device 44 relative to the information carriers 43, which enables the respective configuration of the bending stamp 41 and/or the bending die 39 to be detected rapidly. This brief tool detection would not be possible if the detection device 44 were operated on a discontinuous stop-and-go basis.

Figure 3:
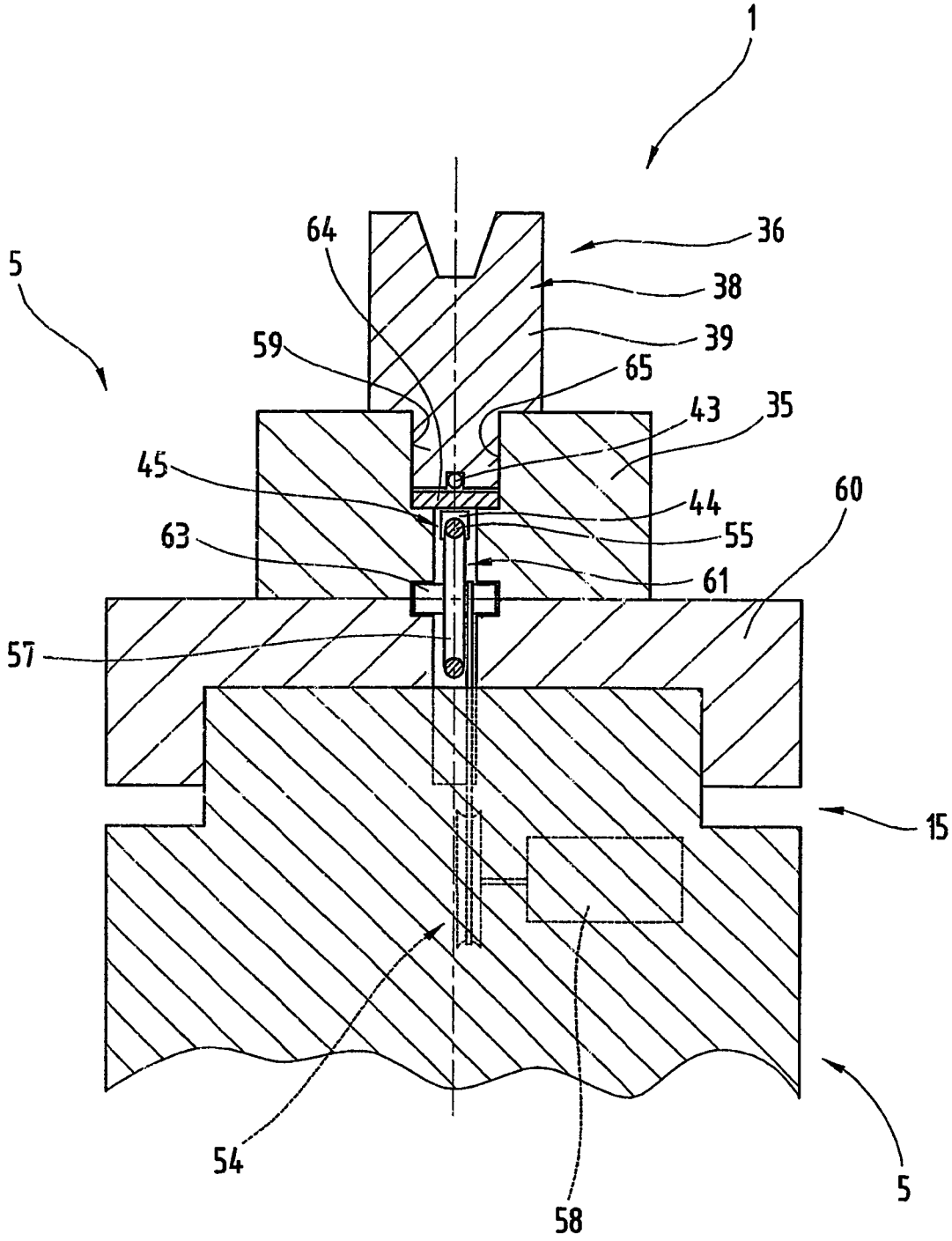
FIG. 3 is a simplified, schematic diagram seen in section along line III-III indicated in FIG. 4, showing another embodiment of a displacement and/or guide mechanism in the sub-structure of a generic production unit.
Figure 4:
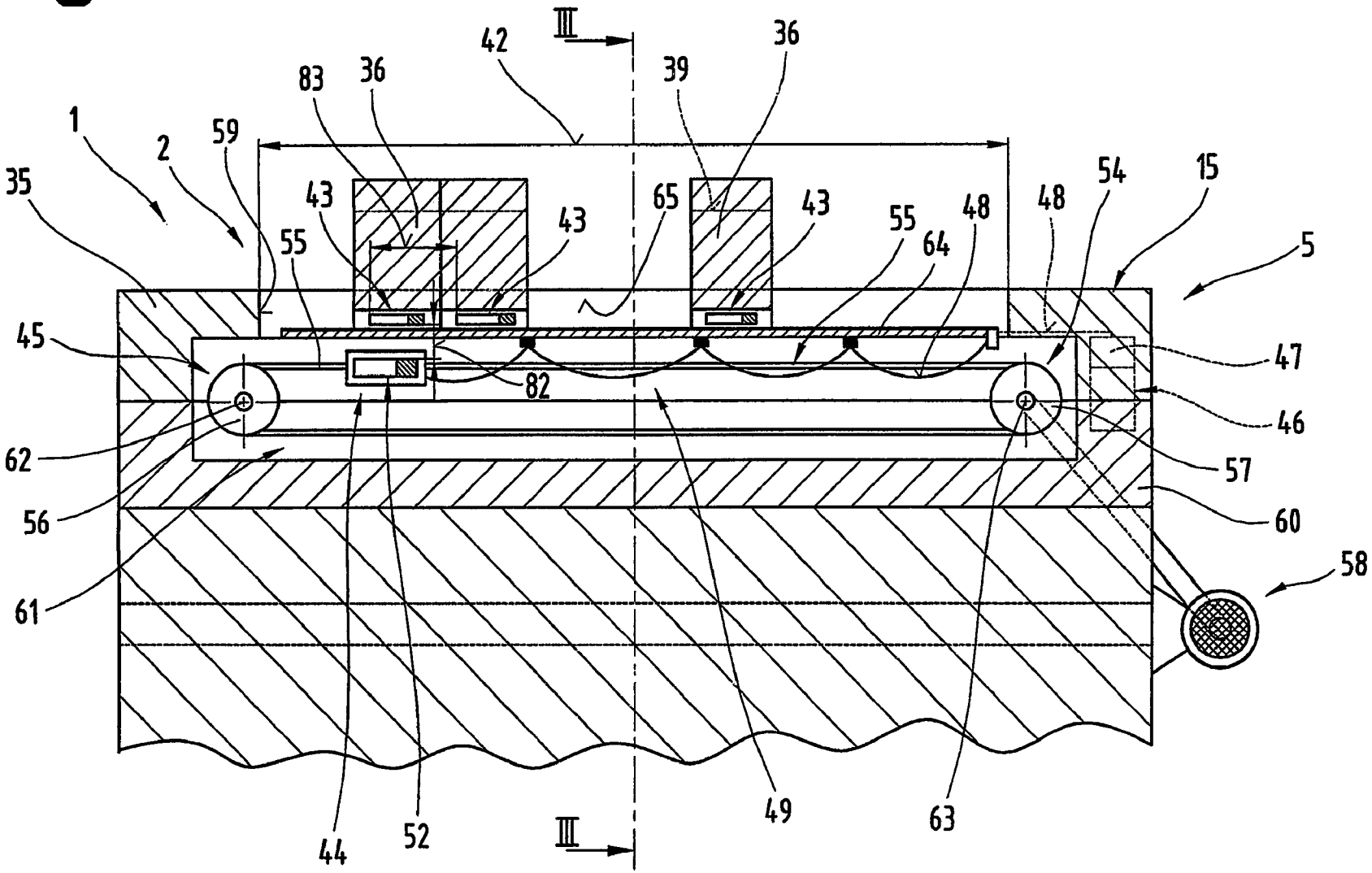
FIG. 4 is a simplified, schematic diagram in longitudinal section, showing the substructure of a production unit incorporating the displacement and/or guide mechanism for the electronic tool detection system according to FIG. 3.

As an alternative to or in combination with a manual displacement of the detection device 44 along the displacement and/or guide mechanism 45, it may be useful to provide a drive mechanism 54 to enable the detection device 44 to be controlled on an automated basis, as schematically illustrated in the diagrams of FIGS. 3 and 4.

The embodiment of a displacement and/or guide mechanism 45 illustrated as an example in FIGS. 3 and 4 has the drive mechanism 54 for the detection device 44 connected to the bottom press beam 5 or in combination with the press table. Naturally, in a similar or identical manner, it would also be possible to provide a drive mechanism 54 of this type for a detection device 44 co-operating with the top press beam 16—FIG. 2. This being the case, the mechanical and electromechanical components of this drive mechanism 54 may be disposed on an external face of the support frame or the machine frame 5 of the bending press 2—as illustrated in FIG. 2, or, alternatively, as illustrated in FIGS. 3 and 4, at least partially integrated in the interior of the supporting or load-bearing components of the generic machine.

In the embodiment illustrated here, this drive mechanism 54 has a flexible transport element 55 in the form of a belt, a chain or a cable. The transport element 55 is preferably of an endless design and is guided round at least two rotatably mounted pulley blocks 56, 57, in which case the transport element 55 is an endless loop and is at least slightly tensed between the pulley blocks 56, 57. The displacement path defined between the pulley blocks 56, 57 for the detection device 44 attached to the transport element 55 extends at least across the maximum possible tool length 42 of the production unit 1, in particular the bending press 2.

Alternatively, it would also be possible for the flexible transport element 55 to be guided around two mutually spaced winding spools, in which case each of the two ends of the transport element 55 would be attached to a winding spool and the transport element 55 at least slightly tensed between the two winding spools. This would then enable the transport element 55 together with the detection device 44 to be moved along the requisite displacement path in two directions, and as far as possible linearly, by the complementary winding and unwinding movements of each of the winding spools.

A displacement drive 58 for the transport element 55 is preferably provided in the form of a drive powered by an electric motor. Alternatively, it would naturally also be possible to use pneumatic or hydraulic drives for the belt- or pulley-type transport element 55.

The displacement and/or guide mechanism 45 for the detection device 44 can be driven or controlled on an automated basis and therefore incorporates the flexible, preferably endlessly circulating transport element 55 with the detection device 44 attached to it, which is drivingly linked to a displacement drive 58 which can be electrically activated. This displacement drive 58 is preferably reversible in its direction of rotation or motion so that the detection device 44 can be moved along the maximum possible tool length 42 in both directions. The bi-directional, reversible operation of the displacement and/or guide mechanism 45 or the endless transport element 55 and the displacement drive 58 is preferable to the system which circulates in one direction only if the corresponding signals or data are transmitted via the line connection 48 between the detection device 44 and the electronic control and/or evaluation device 47 or control device 46 of the bending press 2. This will prevent line connection 48, which is preferably provided in the form of a cable, from becoming twisted.

The line connection 48 from the detection device 44 to the control device 46 again has a trailing cable system 49, at least in the region where it bridges the maximum possible displacement path of the displacement and/or guide mechanism 45, in the form of suspended cable loops which can be moved out of the way, or a cable running and cable reel device in the form of a drum for the corresponding cable.

As will also be clear from comparing FIGS. 3 and 4, the displacement and/or guide mechanism 45 for the detection device 44 in this case is countersunk in the press table or at least partially integrated in it. A groove-shaped recess 59 is specifically provided at least in the tool holder mechanism 35 in which the transport element 55 with the detection device 44 attached to it runs. Accordingly, by reference to its longitudinal direction, the recess 59 extends more or less across the maximum possible tool length 42 so as to ensure that the respective bending tools 36 retained by the tool holder mechanism 35 are reliably detected or picked up. This recess 59 in the tool holder mechanism 35 may also extend into the press beam 15 and into a table top 60 of the press table, in which case it will be possible to accommodate displacement and/or guide mechanisms 45 of relatively generous dimensions. This enables a hollow compartment 61 which is essentially closed off from the exterior to be provided in the press beam 15 or in the press table, in which the displacement and/or guide mechanism 45 or at least its transport element 55 and the detection device 44 can be safely protected from external influences or the effects of forces. It would also be possible, for example, for the pulley blocks 56, 57 to be disposed at the end-face or distal end regions of the press table and to guide only the endless transport element 55 together with the detection device 44 in the interior of the machine frame 5. The dimensions of the hollow compartment 61 may therefore be reduced, in which case the dimensional rigidity of the press table or the press beam 15 will hardly be impaired at all.

Instead of mounting the pulley blocks 56, 57 on horizontally oriented rotation axes 62, 63, it would naturally also be possible to provide vertically oriented rotation axes 62, 63 for the pulley blocks 56, 57. Especially if the pulley blocks 56, 57 are mounted so that they are virtually lying down, a half or a strand of the circulating transport element 55 may also be guided outside of the load-bearing machine frame 5.

As also schematically illustrated, the rotation axes 62, 63 for the pulley blocks 56, 57 may be mounted between the top face of the table top 60 and the bottom face of the tool holding mechanism 35. This simplifies assembly and provides unhindered access to the displacement and/or guide mechanism 45 for any maintenance or modification work which might be needed and/or for control purposes.

The groove-shaped recess 59 in the tool holder mechanism 35 may also be of a stepped design, starting from the top face of the tool holder mechanism 35 in the direction towards the floor, on which the machine frame 5 stands in order to mount or support a plate-type cover element 64. This removable cover element 64 which may be placed in and removed from the recess 54 as and when necessary results in a virtual spatial division in the recess 59 between a top tool-holder groove 65 and the housing or hollow compartment 61 disposed underneath, which is provided as a means of accommodating at least the belt- or cable-type flexible transport element 55 along with the detection device 44.

The plate-shaped cover element 64 between the hollow compartment 61 and the tool holder groove 65 for the bending tools 36 prevents or minimises the amount of dirt which is able to reach the transport element 55 and the detection device 44 lying underneath the bending tools 36. This separating or cover element 64 between the tool holder groove 65 and the hollow compartment 61 for the detection device 44, which is relatively displaceable therein, also prevents the detection device 44 from becoming hooked on the bending tools 36 and the information carriers 43 as the transport mechanism 44 is guided relatively close alongside the information carriers 43 and the bending tool 36. The cover element 64 can then be removed, providing an easy means of gaining access to the detection device 44 and transport element 55 and/or the other components of the displacement and/or guide mechanism 45.

Figure 5:
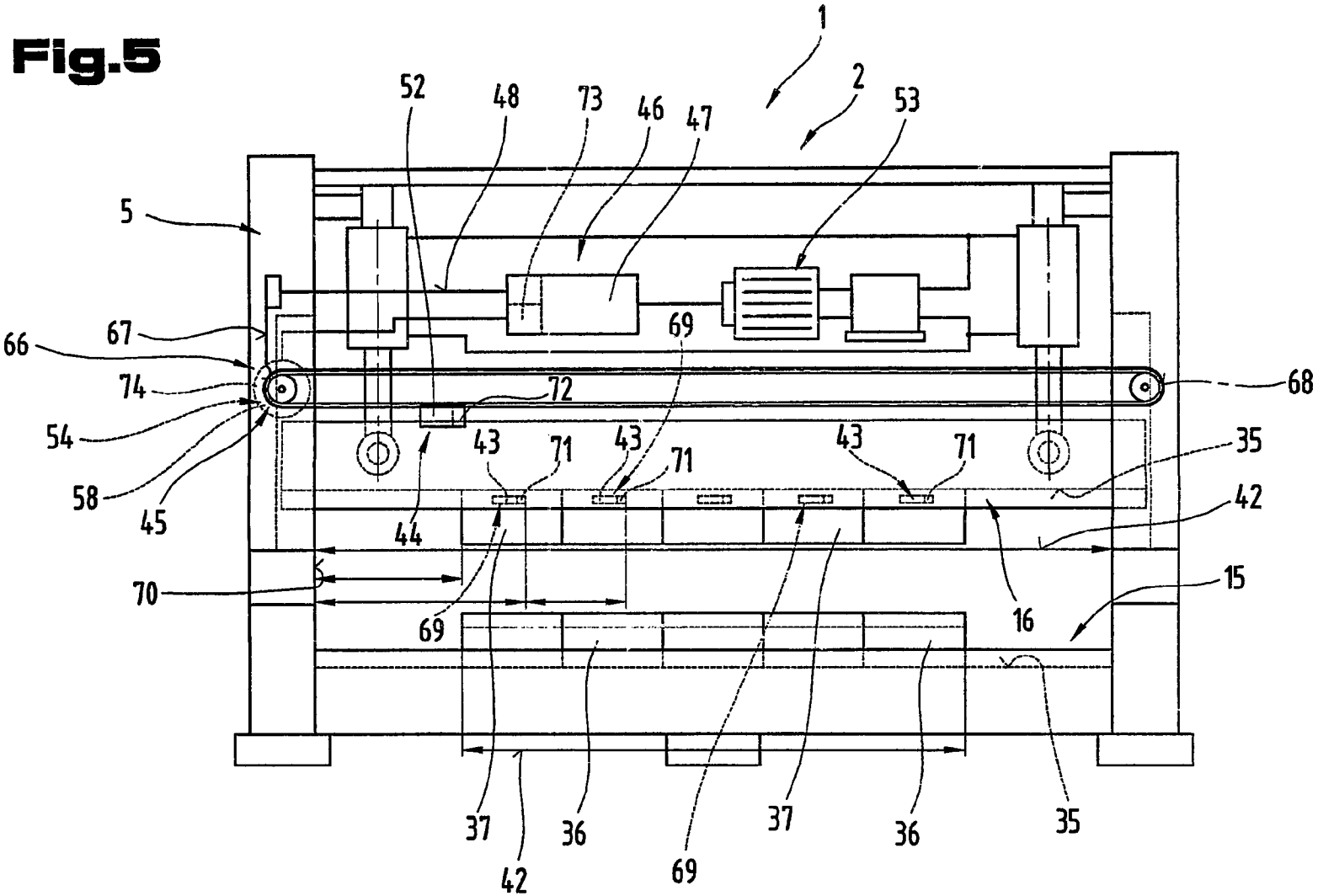
FIG. 5 is a highly simplified, schematic diagram of a production unit with another embodiment of a tool detection system.

FIG. 5 shows another embodiment of a tool detection system for a production unit 1, in particular for a bending press 2 or a so-called die forging press. To provide a clearer illustration, panelling and covers have been left out of the drawing, which is a highly simplified and schematic diagram intended to provide an easier understanding of how things fit together.

In this instance, the displacement and/or guide mechanism 45 for the detection device 44 cooperates with the adjacent top press beam 16. Again, the displacement and/or guide mechanism 45 extends essentially parallel with the possible tool length 42 and bears the detection device 44 for the information carriers 43 of the various bending tools 37, which operates without touching or making contact. The detection device 44 consecutively detects the codes or data of a plurality of information carriers 43 by means of a manual and/or automated, motor-driven relative displacement along the displacement and/or guide mechanism 45 and transmits them to the control device 46 or a control and/or evaluation device 47 co-operating with it to enable the relevant information to be processed and evaluated by the control device 46 or the control and/or evaluation device 47.

The signal or data transmission from the displaceable detection device 44 to the electronic control device 46 takes place in at least part-sections via a line connection 48. A sliding contact system 66 is provided to enable signals to be transmitted from the displaceably mounted detection device 44 to a stationary point on the machine frame 5. This sliding contact system 66 comprises a slide contact 67 attached to the machine frame 5 or to the press beam 16 and at least one conductor track 68 electrically linked to this slide contact 67 in or on the transport element 55. This conductor track 68 preferably terminates on the circulating endless transport element 55, flush with its top face. The at least one conductor track 68 may optionally also be disposed in a groove-shaped recess of the belt- or pulley-type transport element 55.

Electric signals can be sent by means of this at least one conductor track 68 from the detection device 44 via the transport element 55 to the slide contact 67 and then transmitted to the control device 46. Likewise, electric signals may also be transmitted from the control device 46 via the line connection 48, the slide contact 67 and the conductor track 68 on the transport element 55 to the detection device 44. To this end, electric inputs and/or outputs of the detection device 44 are electrically connected to at least one conductor track 68 in or on the transport element 55. This conductor track 68 is extremely flexible and may be provided in the form of a thin-film track of copper or by any other electrical conductor. In any event, the slide contact 67 is electrically connected to the control device 46 and to the co-operating control and/or evaluation device 47 via the line connection 48.

It is of practical advantage if contact with the conductor track 68 is made from the top face of the transport element 55 and at least one conductor track 68 is electrically isolated from the pulley blocks 56, 57 so that the electric signals to be transmitted on the at least one conductor track 68 are not transmitted to the machine frame 5. The set or reference potential of the electric signals may be set up by means of a so-called ground connection on the machine frame 5. If this is not desirable, at least two electric conductor tracks 68 may be run on the transport element 55, co-operating with a multiple sliding contact system 66.

Alternatively, another possibility is to design the belt-type or pulley-type transport element 55 itself as an electric conductor so that it also constitutes the electric conductor track 68. In particular, the transport element 55 may be provided in the form of a metal cable, which is electrically connected to the slide contact 67. Specifically in this case, the electrically conductive transport element 55 will then be electrically isolated from the machine frame 5, in which case the pulley blocks 56, 57 will be made from a non-conductive material such as plastic, and the transport element 55 will not be in contact with the machine frame 5 or any other parts of the bending press 2. This can easily be achieved by disposing and dimensioning the displacement and/or guide mechanism 45 accordingly. The machine frame 5 or parts of it then determine the reference potential so that electric signals between the machine frame and the transport element 55 can be picked up by or fed to the detection device 44.

In one advantageous embodiment, the information carriers 43 have at least one passive position detection element 69 or the information carriers 43 themselves are passive position detection elements 69. The passive position detection element 69 enables the relative position of the individual bending tools 36 and 37 with regard to the maximum possible tool length 42 to be detected, i.e. the position of the individual bending tools 36 or 37 in their tool holder mechanisms 35 relative to an initial point 70 or original position, on an automated basis. This initial point 70 may be the so-called zero dimension of the production unit 1 or bending press 2.

The passive position detection element 69 of the information carriers 43 is preferably provided in the form of a simple metal screen 71 or an equivalent metal object, which constitutes a marker or code indicating the presence of a bending tool 37.

The presence of such a screen 71 can be detected by the detection device 44. In particular, the detection device 44 has an inductive sensor 72, preferably a so-called Hall-effect sensor, which contactlessly detects a detection device 44 as it approaches or passes by the screen 71. In particular, when the sensor 72 is in proximity to the metal screen 71, its electrical properties change and this is detected by the detection device 44 or the control and/or evaluation device 47 or the control device 46. This change in signal state at the sensor 72 is an indication that the detection device 44 is disposed in the vicinity of or immediately adjacent to the metal screen 71. The screen 71 is preferably directly coupled with the information carrier 43 or, for example, the screen 71 may be provided in the form of the housing or another metal element of the information carrier 43.

In addition to detecting the nature or properties of the bending tools 36, 37, the detection device 44 and the sensor 72 co-operating with it also enable the usage or application positions of the respective bending tools 36; 37 to be detected relative to the tool holder mechanism 35 and relative to the available tool length 42 on an at least partially automated basis. To this end, the detection device 44 or the control and/or evaluation device 47 also has a distance-measuring device 73, by means of which the displacement path covered by the detection device 44 can be detected. A distance-measuring device 73 of this type operates, in a known manner, by counting pulses, which are directly correlated to a specific distance or a specific rotation angle or rotation speed of a rotating motion, e.g. of a motor. The pulse transmitters used for the distance-measuring device 73 are those of the incremental transmitter type or rotation angle transmitters, which are well known from the prior art.

Particularly in applications where the displacement and/or guide mechanism 45 used as the displacement drive 58 has a stepper motor 74, the distance-measuring device 73 can use this stepper motor 74 as a means of detecting the distances covered by the detection device 44 or sensor 72 and thus as a means of determining the position of the individual information carriers 43 and bending tools 36, 37 by reference to a defined initial point 70. The actual positions of the individual bending tools 36; 37 determined as a result can then be used by the control device 46 for control and monitoring purposes to ensure that the bending tools 36; 37 are in the correct operating position.

Figure 7:
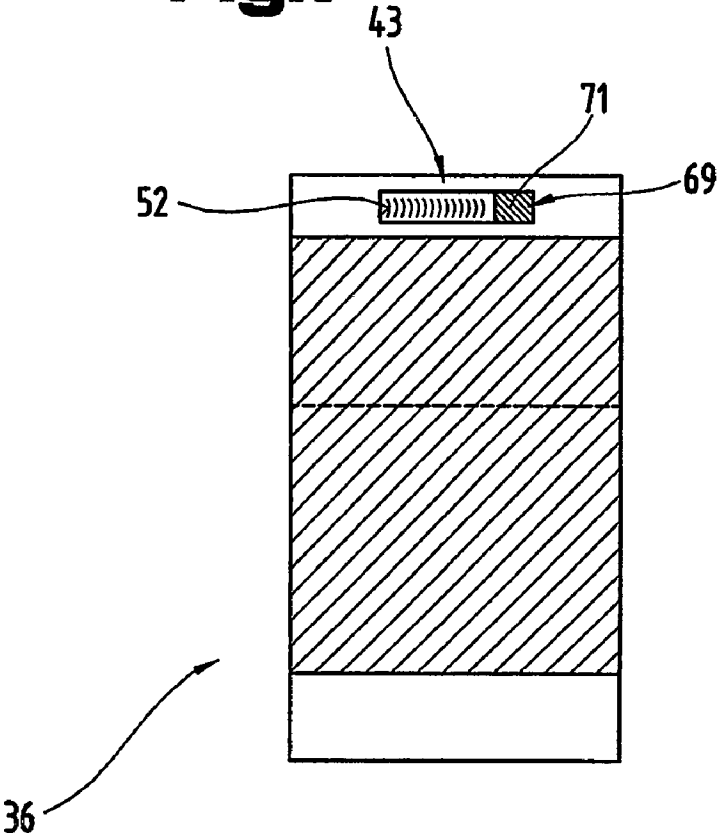
FIG. 7 is a diagram in section showing an example of a tool with the electronic information carrier and a passive position detection element.
Figure 6:
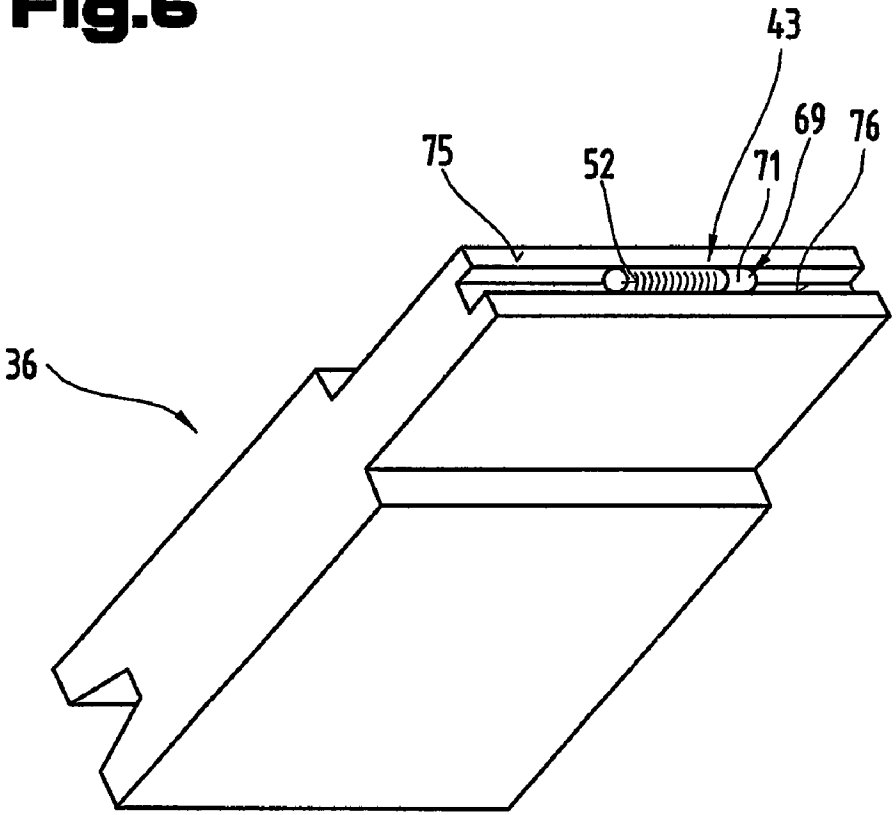
FIG. 6 is a simplified perspective diagram showing a bending tool with an information carrier disposed in its bottom face.

The bending tool 36 illustrated in FIGS. 6 and 7 is equipped with an electronically or electromagnetically detectable information carrier 43.

The information carrier 43 in this case co-operates with a base surface 75 of the bending tool 36. In particular, the base surface 75 has a groove-shaped recess 76, in which at least one information carrier 43 is housed. This offers a simple yet effective means of protecting against damage on the one hand and also means that detectability is good because the antenna or the transmitter and/or receiver device 52 of the information carrier 43 is only partially surrounded by the metal of the bending tools 36 and is therefore only slightly screened.

Instead of opting for the embodiment with a channel or groove-shaped recess 76, it would naturally also be possible to provide a bore in the region of the base surface 75 or in the bottom end region facing the tool holder mechanism 35—FIG. 5—and to insert the information carrier 43 in this bore to protect it from being damaged.

Depending on the circumstances, it may be preferable for the information carrier 43 to be designed so that it can be connected to the respective bending tool 36 but can also be removed or replaced. This would facilitate programming routines and enable damaged information carriers 43 to be easily replaced.

Figure 8:
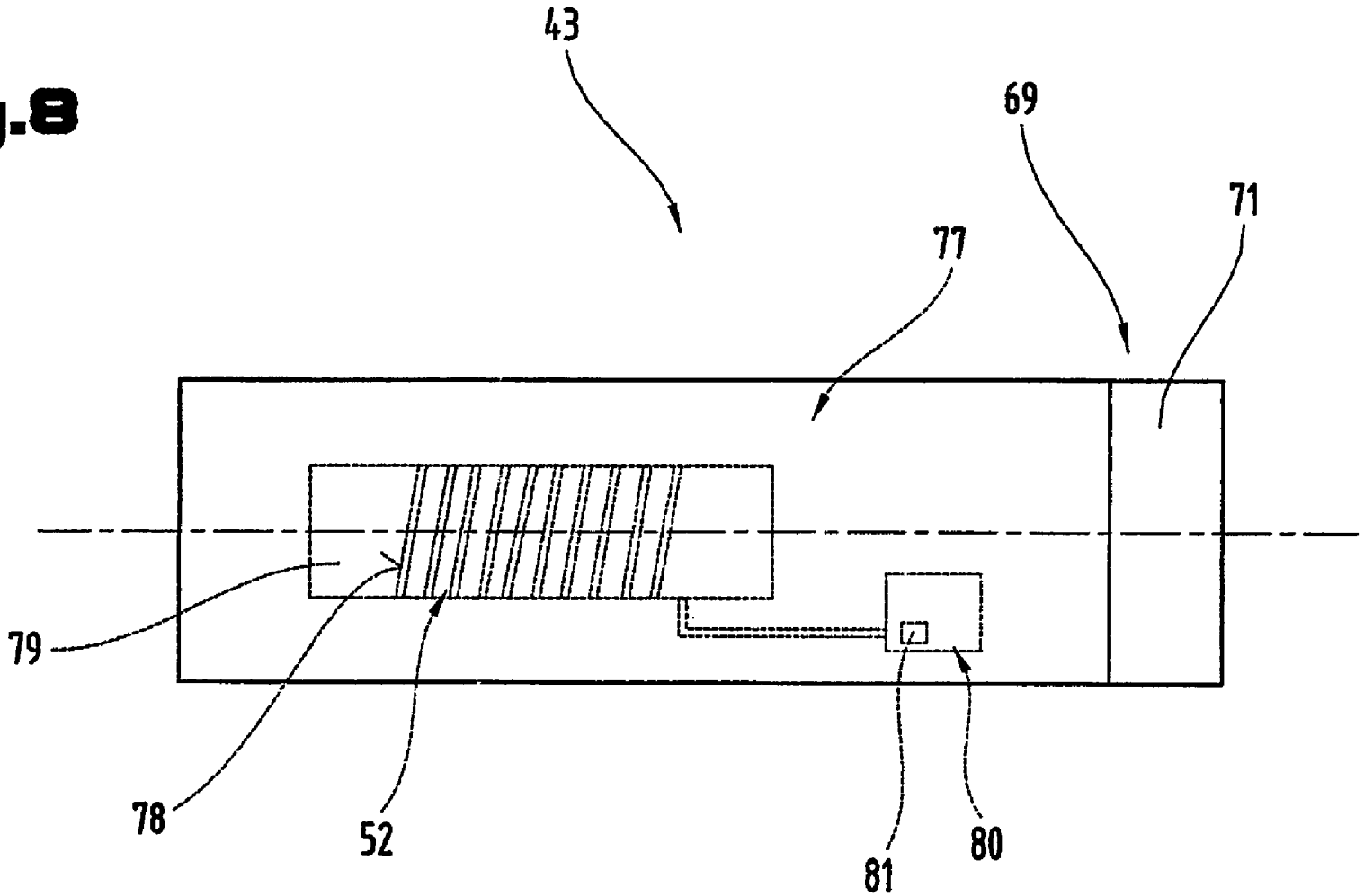
FIG. 8 is a simplified, schematic diagram showing an electronic information carrier for the tool detection system.

FIG. 8 illustrates another possible embodiment of an electronic information carrier 43. The information carrier 43 in this instance is provided in the form of a transponder 77 with integrated semiconductor circuits. In a manner known per se, this transponder 77 has a passive transmitter and/or receiver antenna 78, essentially comprising a coil arrangement with several conductor loops. Electromagnetic waves of a specific frequency can be received and/or transmitted via this transmitter and/or receiver antenna 78. Optionally—as schematically illustrated—the transmitter and/or receiver antenna 78 may also have a coil core 79 in order to improve reception capacity or transmission capacity.

This transmitter and/or receiver antenna 78 may also serve as a power source for an electronic circuit 80 of the transponder 77. Particularly if the transmitter and/or receiver antenna 78 is exposed to an electromagnetic alternating field, electrical energy will be induced in the coil arrangement, which can be used to supply or operate the integrated circuit 80. An energy storage is preferably provided in this electronic circuit 80, for example in the form of a capacitor, with will permit a sufficiently long operating time during which the transponder 77 is preferably operated without a battery when the electromagnetic alternating field is terminated. This results in the longest possible maintenance-free times and constitutes a relatively inexpensive electronic information carrier 43 for the bending tools 36; 37—see FIGS. 1 to 7.

When the integrated circuit 80 is supplied with electric power via the transmitter and/or receiver antenna 78, the latter reads at least its code and/or the relevant data from a memory device 81 co-operating with it and transmits it, optionally via the same transmitter and/or receiver antenna 78 or wirelessly via a co-operating transmitter and/or receiver device 52 specifically configured for it, to the detection device 44, as may be seen from a comparison of the drawings described above.

The essential factor is that the information carrier 43 provided in the form of a transponder 77 operates in only a restricted operating range or environment relative to the detection device 44—see FIGS. 1 to 5. In other words, the detection device 44 does not pick up the relevant data or codes from the memory device 81 unless the transponder 77 and the detection device 44 are disposed within a defined distance from one another or are within a pre-defined limited operating range. This range will depend on the sensitivity of the transponder 77 and the power of the detection device 44 and is usually between 1 cm to approximately 50 cm.

This information carrier 43 will be explained in more detail with reference to the previous drawings. In order to ensure that the detection device 44 is able to obtain or receive the respective codes or data of the consecutively disposed bending tools 36; 37 consecutively in time yet using simple means, it is of advantage if a maximum detection distance 82 between the displaceably mounted detection device 44 and an information carrier 43 of an adjacent bending tool 36; 37 is smaller than a smallest possible distance 83 between two information carriers 43 when the bending tools 36 or 37 are lined up in a row next to one another without gaps, as schematically illustrated in FIG. 4. By adopting these precautions in terms of construction, the detection device 44 is able to receive a plurality of codes of different information carriers 43 not in parallel but simultaneously. Since the individual signals or data occur in a time sequence, the sequence of the bending tools 36; 37 positioned across the tool length 42 can also be reliably detected.

Optionally, the information carrier 43 or the transponder 77 used for this purpose may also incorporate a memory device 81, which permits access to both reading and writing routines. This will enable changing data or properties to be permanently stored in the memory device 81. In particular, by permitting access to the information carrier 43 or its memory device 81 for writing purposes, information or data that is subject to change can be easily kept up to date via the detection device 44, for example. Particularly as the detection device passes by or is positioned in the vicinity of an information carrier 43, the data content and/or data set of its memory device 81 can be at least partially updated. The non-volatile memory device 81 may be provided in the form of a so-called EEPROM memory, for example. Naturally, it would also be conceivable to use any other rewriteable memory devices 81 which do not require a permanent power supply to enable the relevant data to be stored on a permanent basis.

The data stored in the memory device 81, which preferably can not be changed or is defined on the basis of a non-editable code, might include information about geometries or dimensions, maximum load capacity and/or production information or a product number. At least some of the data relating to tool parameters may optionally be stored in the memory device 81 in such a way that it can be edited. This is of particular advantage if the bending tool 36; 37 was altered or modified by finishing processes and these new tool parameters or geometries need to be updated in the memory device 81.

Another possible option is to run a continuous update of and store information about the amount of uses or number of previous uses of the respective bending tools 36; 37 in the information carrier 43. In particular, in combination with the control device 46, a service history management system can be set up for the bending tools 36;37 and in particular when a maximum permitted service time or number of service uses has been exceeded, an appropriate warning can be given, which will provide a fully automated system of preventing further bending or deformation processes being run on workpieces.

The individual data carriers or information carriers 43 may also be used to make it easier and assist with locating specific bending tools 36; 37 in a machine room in which a plurality of production units 1 are operated. This will make it possible to establish in which machine or on which production unit 1 the sought bending tool 36; 37 is mounted. The at least partially automated tool detection system will specifically optimise or reduce the amount of work involved in setting up the production unit 1.

A rewrite function of the memory device 81 will primarily be of importance for setting up and permanently storing so-called historical data and recording it in the memory device 81 of the information carrier 43.

The various components of the so-called transponder 77 or at least some of them are preferably encased in plastic or synthetic resin or accommodated in a corresponding form-imparting housing.

The information carrier 43 may also incorporate or constitute the passive, preferably metal position detection element 69. In principle, this passive position detection element 69 is used merely as a contactlessly detectable code or marker indicating the presence of an information carrier 43 or a bending tool 36; 37. Optionally, a housing or the antenna of the information carrier 43 may also serve as a passive position detection element 69. Such information carriers 43 or position detection elements 69 cause electric detection signals or position signals to be picked up at the detection device 44, which then enable it and/or the control and/or evaluation device 47 to determine or calculate the instantaneous position of the individual bending tools 36; 37—as explained above—after which these determined positions can be evaluated in any manner, e.g. displayed on a display device.

By means of an information carrier 43 of this type, therefore, the positions of each individual bending tool 36; 37 relative to the tool holder or relative to the bending machine can be detected on the one hand, and, on the other hand, the properties or parameters of the respective tool can be detected on an automated basis. In terms of a third group of data or information held in an information carrier 43, the history or service data from one bending tool 36 to another bending tool 37 can be stored.

By contrast with the embodiment illustrated as an example in FIG. 8, it would naturally also be possible, rather than providing the information carrier 43 and the passive position detection element 69 as a single structural unit, to provide them independently of or separately from one another at different positions on a bending tool 36; 37.

As may best be seen from FIG. 1, the displacement and/or guide mechanism 45 may also be provided as a spindle drive 84 in another embodiment, as indicated by the threading shown by broken lines. Specifically in this instance, the rod-shaped guide element 50 is provided in the form of a threaded spindle 85, which is linked to the detection device 44 and its guide carriage 51 via the thread during displacement. The detection device 44 can be moved along the tool length 42 in two directions by means of a reversibly controllable electric motor-driven, pneumatic or hydraulic displacement drive and/or by a manual lever so that all the information carriers 43 are detected or read.

Instead of providing a cable connection between the detection device 44 and the control device 46 or the control and/or evaluation device 47 co-operating with it, it would naturally also be possible to design the transmitter and/or receiver device 52 or a separate transmitter and/or receiver device so that the relevant signals or data can be transmitted totally wirelessly or contactlessly. This being the case, it will be necessary to provide the detection device 44 with a voltage supply system that is independent of the mains network, for example in the form of accumulators or in the form of an inductive energy transmission system.

The control device 46 and/or the control and/or evaluation device 47 connected to it in a communicating relationship are configured in a known manner so that they influence the operating status of the production unit 1 as a function of the states detected by sensors, manual control commands and/or specifications stored in a memory device.

Finally, for the sake of good order, it should be pointed out that in order to provide a clearer understanding of the structure of the production unit 1, it and its constituent parts are illustrated to a certain extent out of proportion and/or on an enlarged scale and/or on a reduced scale.

The underlying objectives and the solutions proposed by the invention may be found in the description. Above all, the embodiments of the subject matter illustrated in FIGS. 1; 2; 3, 4; 5; 6, 7; 8 may be construed as independent solutions proposed by the invention. The objectives and associated solutions may be found in the detailed descriptions of these drawings.

LIST OF REFERENCE NUMBERS

1 Production unit
2 Bending press
3 Workpiece
4 Housing part
5 Machine frame
6 Stand-side panel
7 Stand-side panel
8 Damping element
9 Floor
10 Base plate
11 Distance
12 Mid-plane
13 Wall part
14 Working plane
15 Press beam
16 Press beam
17 Length
18
19 Fixing system
20 End face
21 Leg
22 Side face
23 Side face
24 Leg
25 Actuator drive
26 Actuator drive
27 Drive system
28 Hydraulic cylinder

29 Actuator element
30 Guide means
31 Pivot bearing
32 Bolt
33 Front face
34 Front face
35 Tool holder mechanism
36 Bending tool
37 Bending tool
38 Die
39 Bending die
40 Stamp
41 Bending stamp
42 Tool length
43 Information carrier
44 Detection device
45 Displacement and/or guide mechanism
46 Control device
47 Control and/or evaluation device
48 Line connection
49 Trailing cable system
50 Guide element
51 Guide carriage
52 Transmitter and/or receiver device
53 Drive mechanism (for 1)
54 Drive mechanism (for 44)
55 Transport element
56 Pulley block
57 Pulley block
58 Displacement drive (for 55)
59 Recess
60 Table top
61 Hollow compartment
62 Rotation axis
63 Rotation axis
64 Cover element
65 Tool holder groove
66 Sliding contact system
67 Slide contact
68 Conductor track
69 Position detection element
70 Initial point
71 Screen
72 Sensor
73 Distance measuring device
74 Stepper motor
75 Base surface
76 Recess
77 Transponder
78 Transmitter and/or receiver antenna
79 Coil core
80 Circuit
81 Memory device
82 Detection distance
83 Distance
84 Spindle drive
85 Threaded spindle

The invention claimed is:

1. A bending press for forming workpieces of sheet metal, comprising:

a drive mechanism;

first and second press beams one of which defines a press table, and which are displaceable relative to one another by means of the drive mechanism, each press beam supporting a variable number of bending tools that collectively define a required tool length extending along each press beam;

a control device connected to the drive mechanism for regulating operation of the bending press;

a plurality of electronically detectable information carriers respectively associated with the bending tools, wherein the information carriers have at least machine-readable codes for identifying each bending tool and/or detecting a position of each bending tool;

an electronic detection device connected to the control device and operable to detect the information carriers; and at least one displacement mechanism that defines a displacement path extending parallel with the tool length and that accommodates the detection device such that the detection device is displaceable along the displacement path so that the codes of a plurality of information carriers are detected in sequence during a relative displacement of the detection device along the displacement path and are transmitted to the control device, wherein the displacement mechanism for the detection device is recessed in a press beam or in the press table or is at least partially integrated therein.

2. The bending press as claimed in claim 1, wherein the press table defines a table top, and the displacement mechanism is disposed in a groove-shaped recess in a tool holder mechanism and the recess extends into the press beam and into the table top.

3. The bending press as claimed in claim 2, wherein the recess extends approximately across the maximum possible tool length.

4. The bending press as claimed in claim 2, wherein a hollow compartment closed towards the outside is provided in the press beam and in the press table and the displacement mechanism is disposed in the hollow compartment.

5. The bending press as claimed in claim 4, wherein a plate-type cover element is provided between the hollow compartment and the groove-shaped recess in the tool holder mechanism.

6. The bending press as claimed in claim 1, wherein the detection device is coupled with the control device via a line connection so as to transmit signals.

7. The bending press as claimed in claim 6, wherein the line connection is provided in the form of a trailing cable system disposed within a displacement range of the detection device.

8. The bending press as claimed in claim 1, wherein a maximum detection distance between the detection device and the information carrier of an adjacent bending tool is shorter than a smallest possible distance between two information carriers of bending tools lined up in a row adjacent to one another without any gap therebetween.

9. The bending press as claimed in claim 1, wherein the displacement mechanism is a flexible transport element to which the detection device is attached.

10. The bending press as claimed in claim 9, wherein the displacement mechanism further comprises two spaced pulley blocks or winding spools about which the flexible transport element is guided.

11. The bending press as claimed in claim 1, wherein the displacement mechanism has a guide element with a guide carriage relatively displaceable thereto, on which the detection device is disposed.

12. The bending press as claimed in claim 1, wherein the displacement mechanism has a displacement drive connected to the control device.

13. The bending press as claimed in claim 12, wherein the displacement drive is operable to be reversed in direction of rotation or motion.

14. The bending press as claimed in claim 1, wherein the information carriers comprise transponders that are operable to be detected contactlessly or wirelessly.

15. The bending press as claimed in claim 14, wherein the transponders are arranged to operate without batteries.

16. The bending press as claimed in claim 14, wherein the transponders are operable to be inductively or electromagnetically coupled with the detection device via corresponding transmitter and/or receiver devices for electromagnetic waves.

17. The bending press as claimed in claim 1, wherein each of the information carriers has a non-volatile memory device, and the detection device is operable to read from and write to the non-volatile memory devices of the information carriers.

18. The bending press as claimed in claim 1, wherein the information carriers have a passive position detection element.

19. The bending press as claimed in claim 18, wherein the position detection element comprises a metal element on the information carrier.

20. The bending press as claimed in claim 1, wherein the detection device has an inductive sensor for detecting a metal element on or in the region of an information carrier.

21. The bending press as claimed in claim 1, further comprising a distance measuring device that measures a distance along the displacement path travelled by the detection device.

22. The bending press as claimed in claim 1, wherein the displacement mechanism is a displacement drive and has a stepper motor connected to the control device for determining the displacement path and/or controlling the displacement path.

23. The bending press as claimed in claim 9, wherein the flexible transport element has at least one electric conductor track that has an electrical connection to the detection device.

24. The bending press as claimed in claim 23, wherein the conductor track on the transport element is connected to a stationary slide contact so as to pick up and/or transmit electric signals from and to the detection device in a sliding connection.

25. The bending press as claimed in claim 24, wherein the slide contact is connected to the control device.

26. The bending press as claimed in claim 24, wherein contact is made with the conductor track from a top face of the transport element.

27. The bending press as claimed in claim 1, wherein the displacement mechanism has a spindle drive having a threaded spindle, the detection device being mounted the spindle drive and being displaceable in two directions along the tool length by a reversible rotating motion of the threaded spindle.

* * * * *